US009759059B2

(12) United States Patent
Hegeman et al.

(10) Patent No.: US 9,759,059 B2
(45) Date of Patent: Sep. 12, 2017

(54) DETECTION OF PERMEABILITY ANISOTROPY IN THE HORIZONTAL PLANE WITH A FORMATION TESTING TOOL

(71) Applicant: Schlumberger Technology Corporation, Sugar Land, TX (US)

(72) Inventors: Peter Hegeman, Stafford, TX (US); Cosan Ayan, Istanbul (TR); Adriaan Gisolf, Houston, TX (US)

(73) Assignee: SCHLUMBERGE TECHNOLOGY CORPORATION, Sugar Land, TX (US)

( * ) Notice: Subject to any disclaimer, the term of this patent is extended or adjusted under 35 U.S.C. 154(b) by 568 days.

(21) Appl. No.: 13/923,220

(22) Filed: Jun. 20, 2013

(65) Prior Publication Data

US 2014/0373617 A1 Dec. 25, 2014

(51) Int. Cl.
*E21B 47/00* (2012.01)
*E21B 49/00* (2006.01)

(52) U.S. Cl.
CPC ..... *E21B 47/00* (2013.01); *E21B 49/008* (2013.01)

(58) Field of Classification Search
CPC ..... E21B 47/00; E21B 49/008
See application file for complete search history.

(56) References Cited

U.S. PATENT DOCUMENTS

| | | | | |
|---|---|---|---|---|
| 5,156,205 | A | 10/1992 | Prasad et al. | |
| 5,247,830 | A * | 9/1993 | Goode | E21B 49/10 73/152.51 |
| 5,335,542 | A * | 8/1994 | Ramakrishnan | E21B 33/1246 166/250.02 |
| 6,856,132 | B2 * | 2/2005 | Appel | G01V 3/32 324/303 |
| 2003/0094040 | A1 | 5/2003 | Proett et al. | |
| 2004/0090230 | A1 * | 5/2004 | Appel | G01V 3/32 324/307 |
| 2006/0042371 | A1 | 3/2006 | Sheng et al. | |
| 2010/0126717 | A1 | 5/2010 | Kuchuk et al. | |
| 2011/0107830 | A1 | 5/2011 | Fields et al. | |
| 2013/0205886 | A1 | 8/2013 | Hegeman et al. | |

OTHER PUBLICATIONS

Zimmerman, T., MacInnis, J., Hoppe, J., Pop, J., and Long, T,: "Application of Emerging Wireline Formation Technologies," paper OSEA 90105 presented at the 1990 Offshore South East Asia Conference, Singapore, Dec. 4-7.

(Continued)

*Primary Examiner* — John Fitzgerald
(74) *Attorney, Agent, or Firm* — Michael Dae

(57) ABSTRACT

A method including positioning a formation testing tool within a wellbore formed within a subsurface reservoir, wherein the tool has a focused opening to enable fluid communication with the reservoir, and the tool has a horizontally-displaced observation probe configured to obtain pressure data; determining one of horizontal permeability and horizontal mobility of the reservoir based on measuring a flow response of the subsurface reservoir one of at and adjacent to the observation probe; and determining orthogonal components of one of the horizontal permeability and horizontal mobility based on the measured flow response.

11 Claims, 20 Drawing Sheets

(56) References Cited

OTHER PUBLICATIONS

Goode, P.A. and Thambynayagam, R.K.M.: "Permeability Determination With a Multiprobe Formation Tester," SPEFE (Dec. 1992) 297-303. SPE 20737-PA.

Onur, M., Hegeman, P.S., Gok, I.M., and Kuchuk, F.J.: "A Novel Analysis Procedure for Estimating Thickness-Independent Horizontal and Vertical Permeabilities From Pressure Data at an Observation Probe Acquired by Packer-Probe Wireline Formation Testers," SPEREE (Aug. 2011) 457-472. SPE 148403-PA.

Kuchuk, F.J.: "Multiprobe Wireline Formation Tester Pressure Behavior in Crossflow-Layered Reservoirs," IN SITU, 20(1), 1996, 1-40.

International Search Report and the Written Opinion for International Application No. PCT/US2014/043409 dated Oct. 24, 2014.

* cited by examiner

DETECTION OF PERMEABILITY ANISOTROPY IN THE HORIZONTAL PLANE WITH A FORMATION TESTING TOOL

CROSS-REFERENCE TO RELATED APPLICATIONS

None.

FIELD OF THE INVENTION

Aspects described relate to testing of geological formations. More specifically, aspects disclosed relate to testing for anisotropy in the horizontal plane with a formation testing tool.

BACKGROUND INFORMATION

Formation testing tools with discrete openings, such as a multi-probe module, can withdraw formation fluid in a focused direction. With the multi-probe module, formation pressure can be monitored at the flowing probe and two or more observation probes, one positioned on the opposite side of the borehole on the same horizontal plane as the sink probe and others displaced vertically on the same azimuthal plane as the sink probe.

Permeability determination with the multi-probe module has received considerable attention. In particular, the detection and quantification of permeability anisotropy in the horizontal-vertical plane, $k_h/k_v$ has been studied. The detection and quantification of permeability anisotropy within the horizontal plane has received no attention. Knowledge of such anisotropy can be critical for optimum design of reservoir drainage patterns, secondary and tertiary recovery projects, and stimulation treatments, to name but a few examples. Anisotropy within the horizontal plane usually creates three-dimensional anisotropy, with vertical permeability differing from both components ($k_x$ and $k_y$) of horizontal permeability.

SUMMARY

A method comprising positioning a formation testing tool within a wellbore formed within a subsurface reservoir is described, wherein the tool has a focused opening to enable fluid communication with the reservoir, and the tool has a horizontally-displaced observation probe configured to obtain pressure data; determining one of horizontal permeability and horizontal mobility of the reservoir based on measuring a flow response of the subsurface reservoir one of at and adjacent to the observation probe; and determining orthogonal components of one of the horizontal permeability and horizontal mobility based on the measured flow response.

DETAILED DESCRIPTION

"Anisotropy" refers to a variation of a property with the direction in which the value is measured. Rock permeability is a measure of conductivity to fluid flow through pore space. Reservoir rocks often exhibit permeability anisotropy whereby conductivity to fluid depends on the direction of flow of the fluid. This is most often true when comparing permeability measured parallel or substantially parallel to the formation bed boundaries which may be referred to as horizontal permeability, $k_h$, and permeability measured perpendicular or substantially perpendicular to the formation bed boundaries which may be referred to as vertical permeability, $k_v$. Such permeability anisotropy is referred to as two-dimensional (hereinafter "2D") anisotropy. In some cases, there may be anisotropy within the plane parallel or substantially parallel to the formation bed boundaries, such that instead of a single value of horizontal, $k_h$, there may be separate components measured in orthogonal or substantially orthogonal directions, such as, for example, x- and y-directions, referred to as $k_x$ and $k_y$, respectively. Rock that exhibits variation in permeability when measured vertically or substantially vertically, as well as both horizontal or substantially horizontal directions is said to have three dimensional (hereinafter "3D") anisotropy. Rock that exhibits no directional variation in permeability is referred to as "isotropic".

Figure 1:
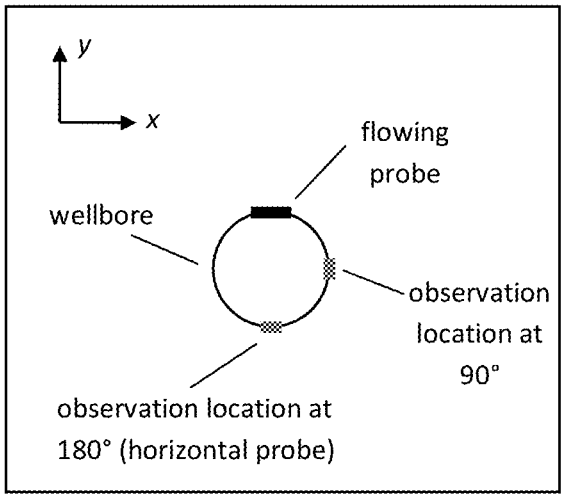
FIG. 1 shows the x and y coordinate plane of a wellbore with associated flowing probe and two observation locations.

A numerical simulation method and model have been created to study the formation pressure response for flow from a discrete-opening (probe) source. Features of the model include:

- 3D flow using a rectangular reservoir grid
- Singular phase, slightly compressible fluid with constant fluid properties
- Rectangular shaped reservoir with no flow outer boundaries
- Logarithmic time stepping The reservoir grid used for analysis may be chosen to allow the grid to approximate the circular shape of the wellbore and the small size of the probes. In a non-limiting example, the smallest grid cells were 0.1 inch cubes. The wellbore was placed at the center of the formation in both the (x-y) and vertical (z) directions. Therefore, because of symmetry, only one quarter of the system needs to simulated. Additionally, to the standard multi-probe observation positions of horizontal (180 degrees (and vertical, another observation location in the horizontal plane at 90 degrees was monitored. FIG. 1 shows these positions. It will be understood that the below described methods and apparatus are applicable to both measure while drilling and logging while drilling methods and apparatus.

Figure 2:
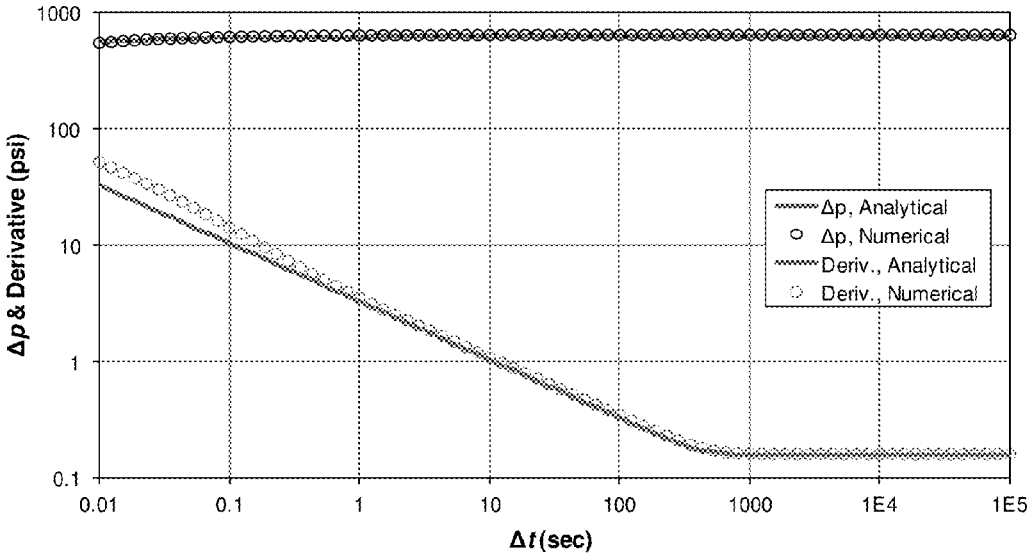
FIG. 2 is a plot of pressure change and derivative at the flowing probe, numerical and analytical models.
Figure 3:
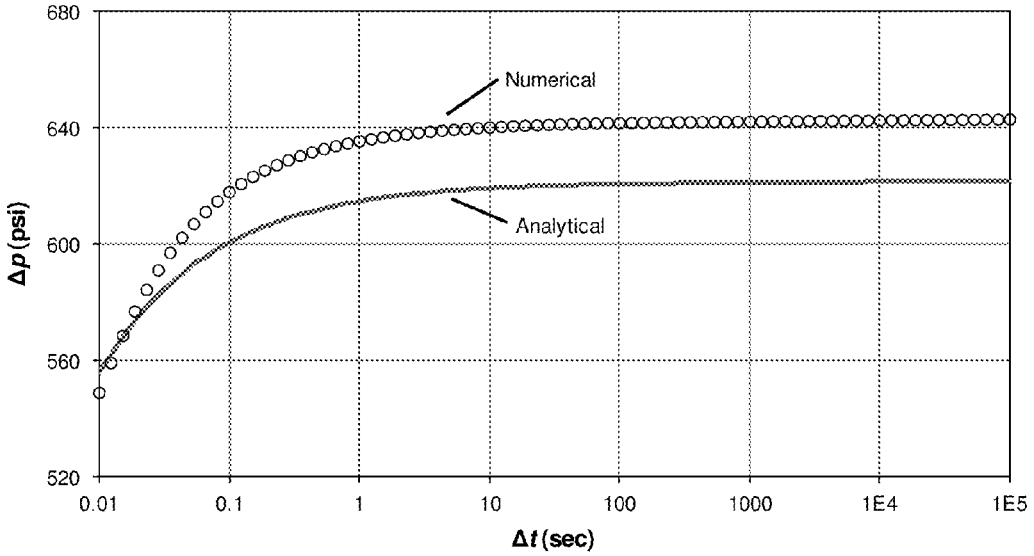
FIG. 3 is a plot of pressure change at the flowing probe, numerical and analytical models.

FIG. 2 shows the pressure change and derivative results for a flowing probe. The agreement between the numerical method and the analytical model is acceptable. Analysis of the numerical model results for spherical flow ($\Delta t$=1 to 100 sec.) and radial flow ($\Delta t$>1000 sec.) yields permeability values with about 2% error. There is a slight shift in the $\Delta p$ values. FIG. 3 presents the $\Delta p$ values on a semilog scale, and the shift of 20 psi is apparent. This shift is less than 3% of the analytical $\Delta p$ and the shift is caused by the different geometries of the probe for the two models.

Figure 4:
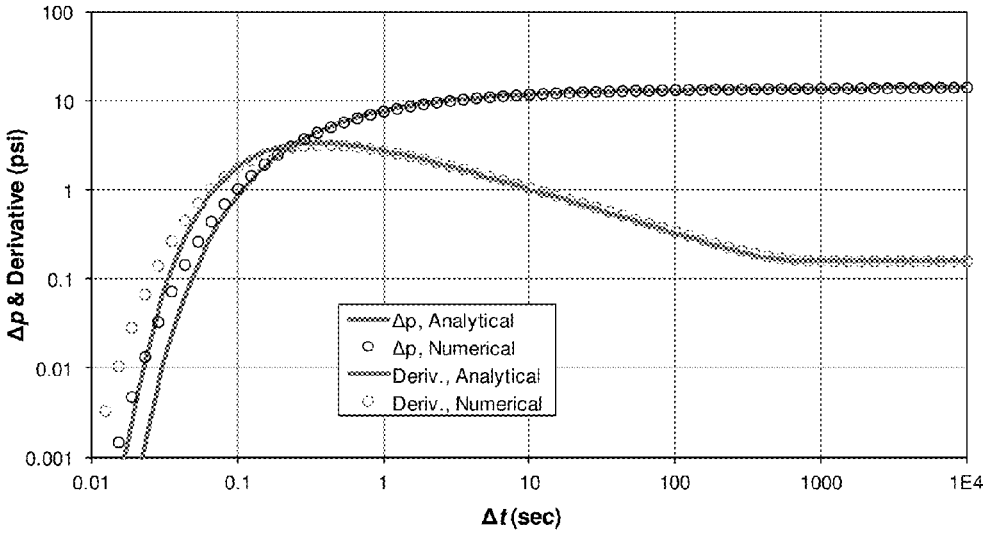
FIG. 4 is a plot of pressure change and derivative at the 180 deg horizontal probe, numerical and analytical models.
Figure 5:
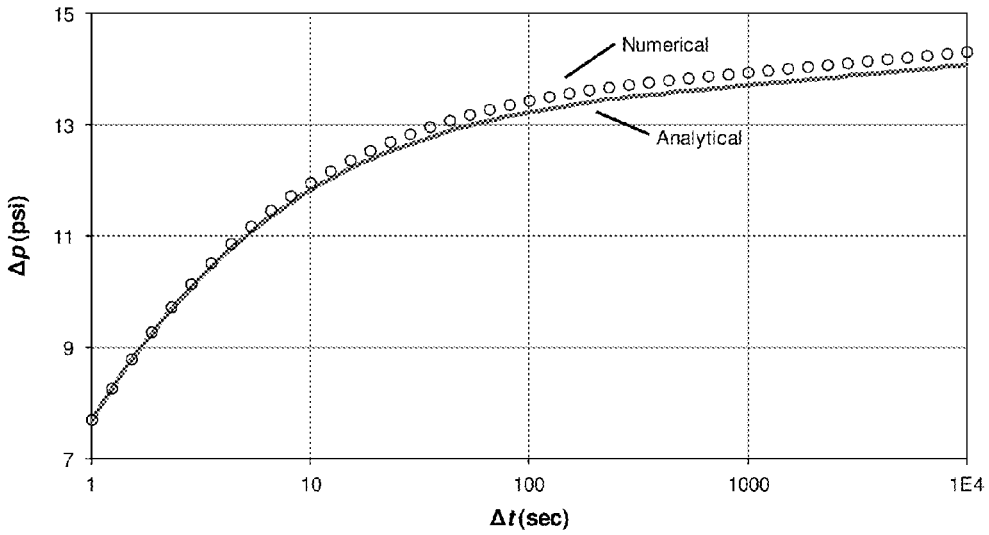
FIG. 5 is a plot of pressure change at the 180 deg horizontal probe, numerical and analytical models.
Figure 6:
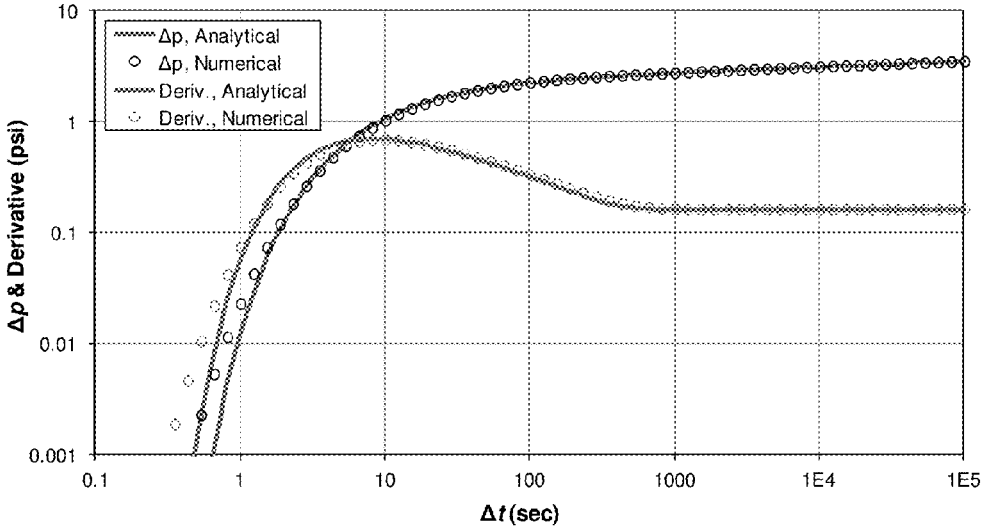
FIG. 6 is a plot of pressure change and derivative at the vertical probe, numerical and analytical models.
Figure 7:
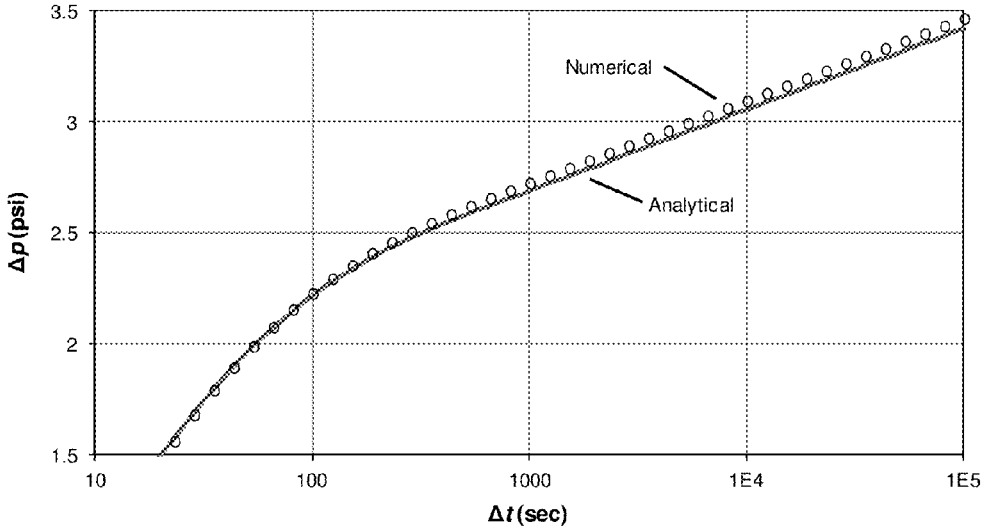
FIG. 7 is a plot of pressure change at the vertical probe, numerical and analytical models.

FIG. 4 (log-log) and FIG. 5 (semilog) display the comparison between the numerical and analytical models for the pressure response at the horizontal observation probe at 180 degrees. The agreement is good after 0.1 seconds. FIG. 6 (log-log) and FIG. 7 (semilog) show the comparison between the two models for the pressure response at the vertical observation probe. The agreement is good after one second. Note that the analytical model does not have the solution for an observation probe at 90 degrees.

In summary, FIGS. 2 through 7 show that the numerical model adequately reproduces the analytical results at the sink and observation probes for the case of 2D ($k_h/k_v$) permeability anisotropy. The validation test case is typical of field cases where interference testing with formation test tools is performed. These results give a sufficient level of confidence that the numerical model will provide accurate results for a system with 3D permeability anisotropy, for which there is no analytical model for the formation test scale wellbore-pressure response.

Permeability anisotropy within the horizontal plane implies $k_x$ does not equal $k_y$. Furthermore, if vertical permeability ($k_z$) differs from both $k_x$ and $k_y$, then there is 3D anisotropy. To study the effect of anisotropy within the horizontal plane, a validation test case ($k_x$=$k_y$=200 millidarcy) was run for two additional cases: $k_x$=800 with $k_y$=50 md, and $k_x$=50 with $k_y$=800 md. Thus, for all three cases the effective horizontal permeability, given by the square root of the product of $k_x$ and $k_y$ was 200 md. All three cases had vertical permeability $k_z$=20 md.

As in the validation case, a constant rate of 6 barrels per day was used but now for $10^7$ seconds (116 days), which is sufficiently long for the outer boundary effects to fully develop. In practice, a formation test would never be run for such a duration, but it is nevertheless a check on the model performance to see that the correct outer boundary effects develop.

Figure 8:
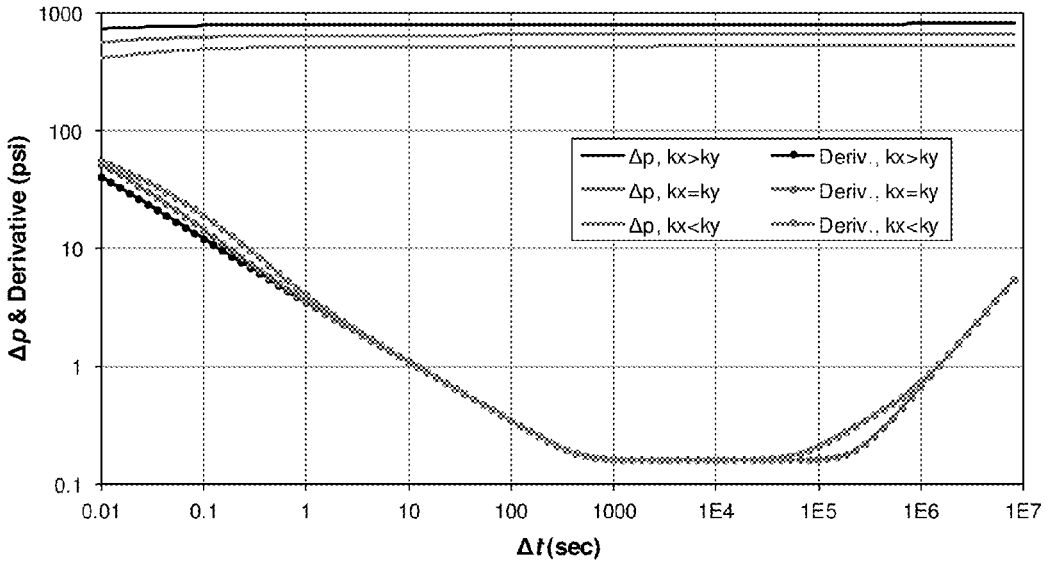
FIG. 8 is a plot of pressure change and derivative at the flowing probe, numerical model, 3D anisotropy.
Figure 9:
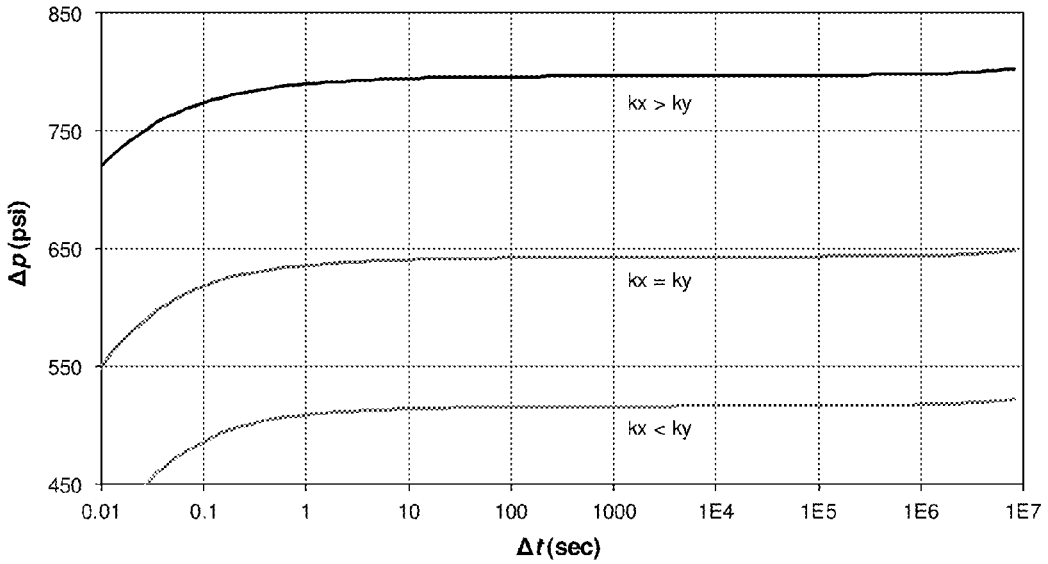
FIG. 9 is a plot of pressure change at the flowing probe, numerical model and 3D anisotropy.

FIG. 8 shows the pressure change, $\Delta p$, and derivative results for the flowing probe. There is an offset in $\Delta p$ values between the three cases, with the largest $\Delta p$ values for the case of $k_y$=50 md. That is, when the permeability perpendicular to the probe face is smallest, the pressure change is the largest. FIG. 9 presents the $\Delta p$ values on a semilog scale and the offset between the curves is apparent. FIG. 8 also shows the derivative curves for all three cases overlay (until late times when the boundary effects are reached; note that the two anisotropic cases overlay, and exhibit a linear boundary flow prior to pseudosteady-state boundary flow).

This overlay of derivatives implies that spherical-flow analysis for each case yields the same value for spherical permeability and radial flow analysis for each case yields the same value for horizontal permeability. Thus, the offset in $\Delta p$ has the appearance of a skin effect. In practice, the flowing location is nearly always influenced by a skin effect, such as drilling damage. Therefore, even though the probe response is clearly influenced by anisotropy in the horizontal plane, from an interpretation perspective, it would be impossible to distinguish between horizontal anisotropy and skin effect at the flowing probe. However, the $k_x$=$k_y$ case yields a negative skin component, so the total skin could be negative. Negative skin is fairly unusual, and thus it could be an indicator of anisotropy in the horizontal plane.

Figure 10:
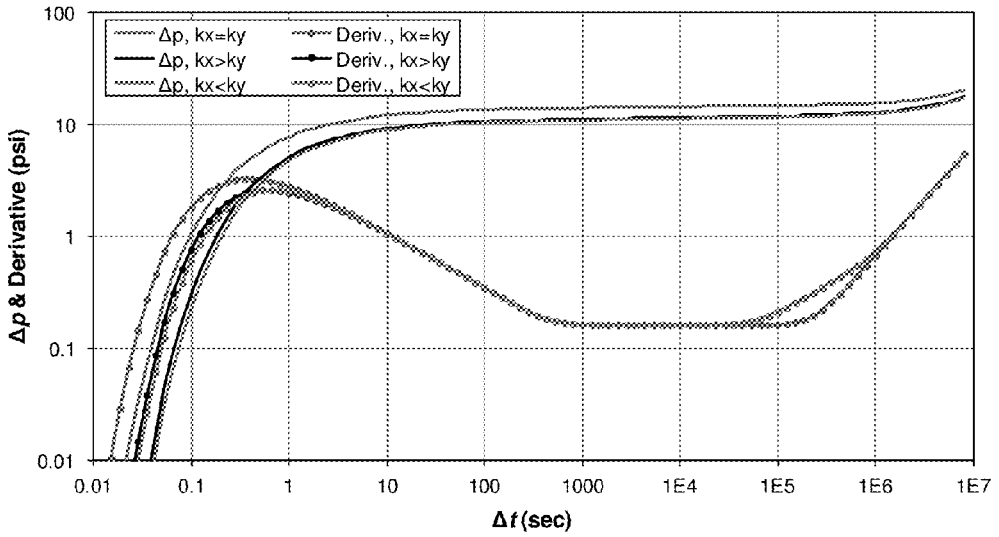
FIG. 10 is a plot of pressure change and derivative at the 180 deg horizontal probe, numerical model, and 3D anisotropy.
Figure 11:
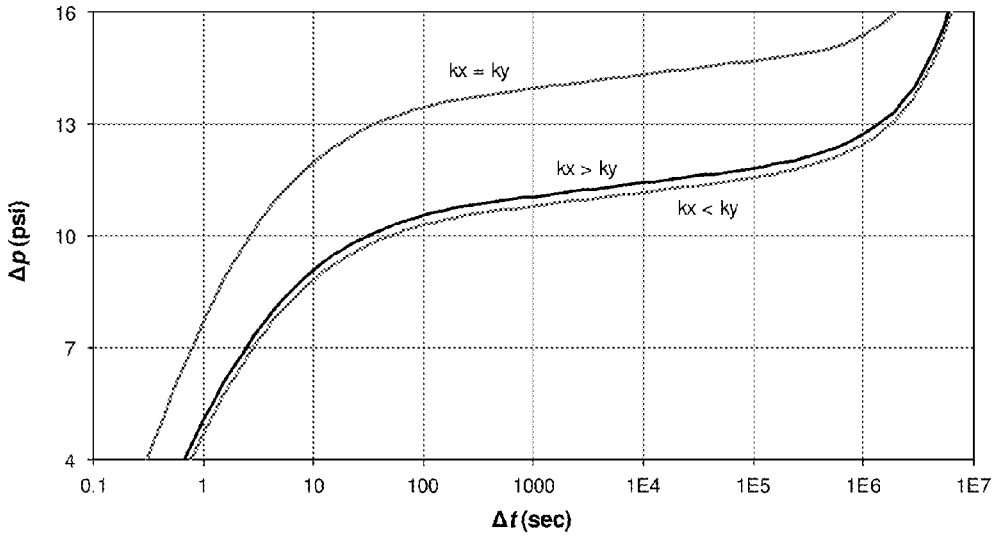
FIG. 11 is a plot of pressure change at the 180 deg horizontal probe numerical model, 3D anisotropy.

FIG. 10 is a log-log graph and FIG. 11 is a semilog plot displaying the pressure responses at a 180 degree horizontal observation probe. After 0.1 seconds, all three derivative curves overlay until late time. Also, the two anisotropic cases $k_x$>$k_y$ and $k_x$<$k_y$, are nearly identical and they are offset from the isotropic case by about 3 psi, which is significant. Unlike the flowing probe, the observation probe is largely unaffected by skin effect. Therefore, from an interpretation perspective, FIGS. 10 and 11 indicate that data from the 180 degree horizontal observation probe could be used to determine $k_h$ as well as unique values for the two components, $k_x$ and $k_y$. It is not possible to determine which value is in the x– direction and which value is in the y direction.

Figure 12:
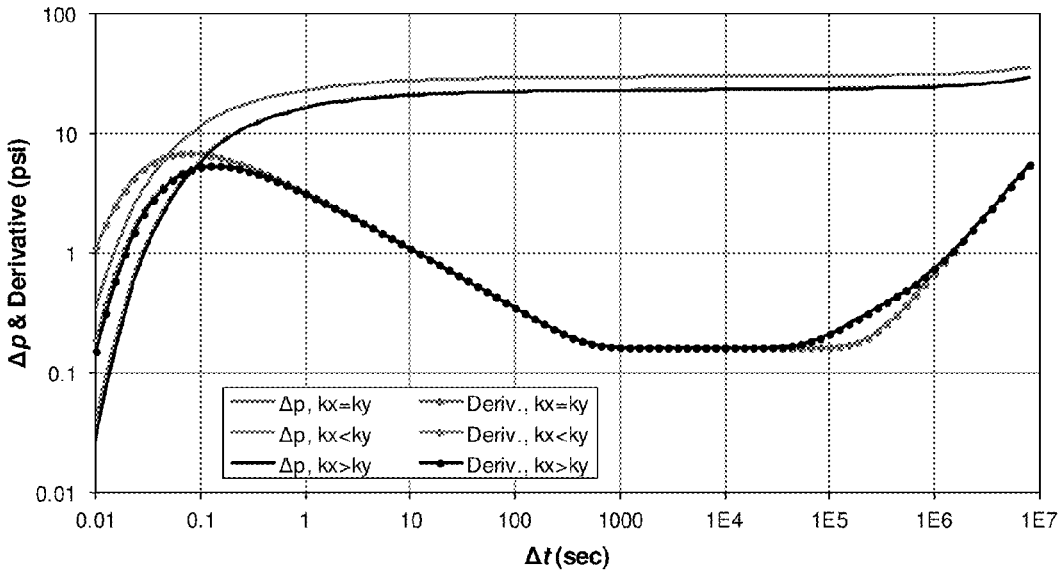
FIG. 12 is a plot of pressure change and derivative at 90 deg horizontal probe, numerical model, 3D anisotropy.
Figure 13:
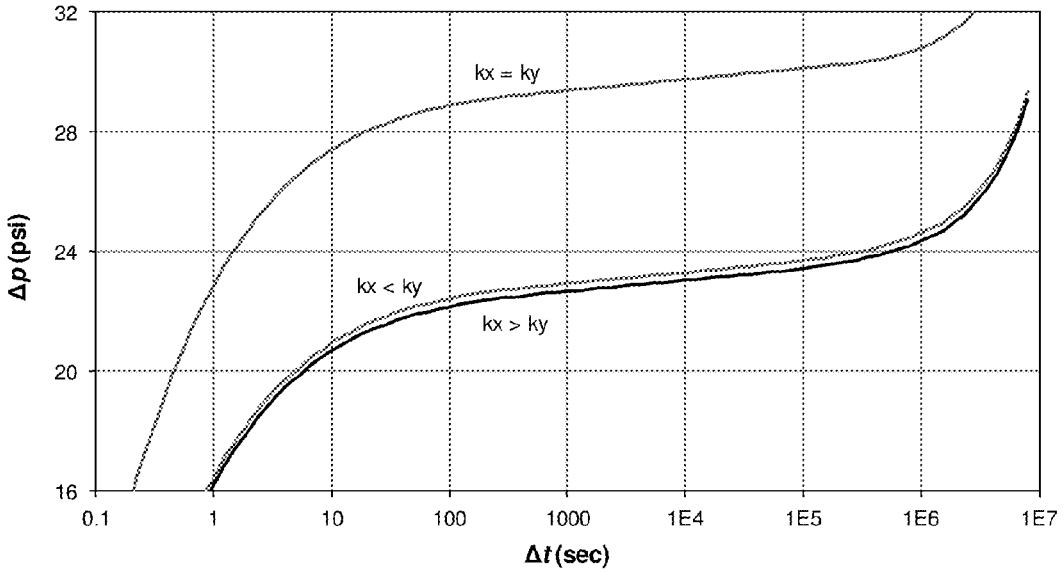
FIG. 13 is a plot of pressure change at 90 deg horizontal probe, numerical model, 3D anisotropy.

FIGS. 12 (log-log) and 13 (semilog) show the pressure responses at the observation location in the horizontal plane at 90 degrees. These results have the same characteristics as the 180 degree horizontal observation probe. The data illustrated allows detection of horizontal anisotropy and quantification of the component values, but it would not be possible to determine which component value is $k_x$ and which is $k_y$.

Figure 14:
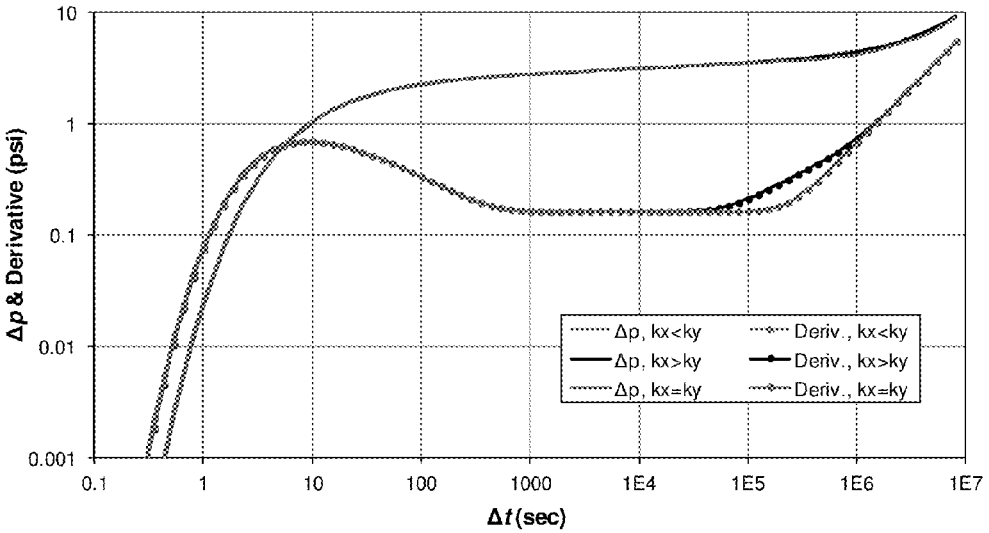
FIG. 14 is a plot of pressure change and derivative at the vertical probe, numerical model, 3D anisotropy.
Figure 15:
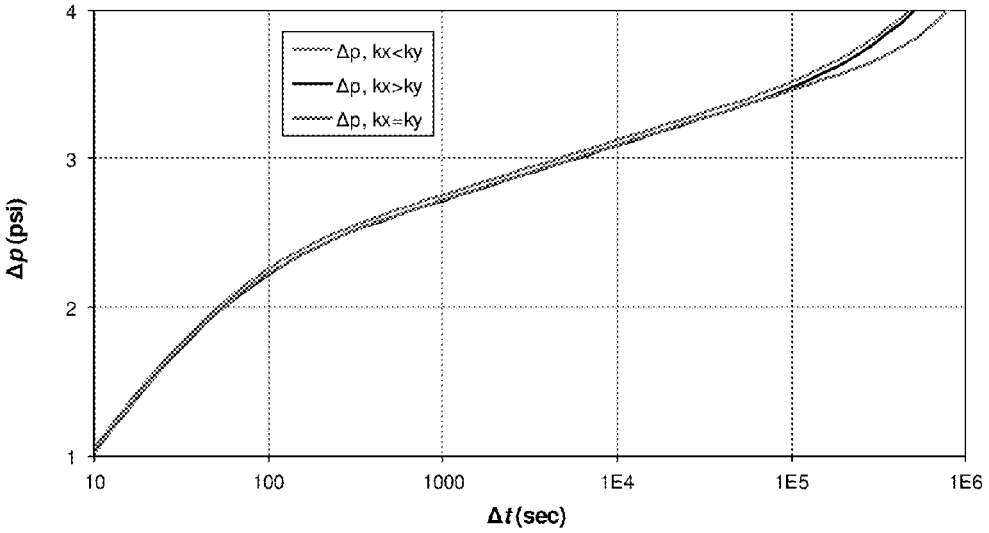
FIG. 15 is a plot of pressure change at the vertical probe, numerical model, 3D anisotropy.

FIGS. 14 (log-log) and 15 (semilog) display the pressure responses at the vertical observation probe. These results indicate that a vertically-displaced observation probe is largely unaffected by anisotropy in the horizontal plane (until outer boundaries affect the data). It would be possible to determine $k_h$ but not the component values.

To further confirm the trends observed with the $k_x$=800, 50 with $k_y$=50, 800 md (16:1 and 1:16) cases, two additional sets of permeability pairs were modeled:

$k_x$=400, 100 with $k_y$=100, 400 md (4:1 and 1:4 cases)

$k_x$=2000, 20 with $k_y$=20, 2000 md (100:1 and 1:100 cases).

Thus all cases have an effective horizontal permeability of $k_h$=square root ($k_x \cdot k_y$)=200 md.

Figure 16:
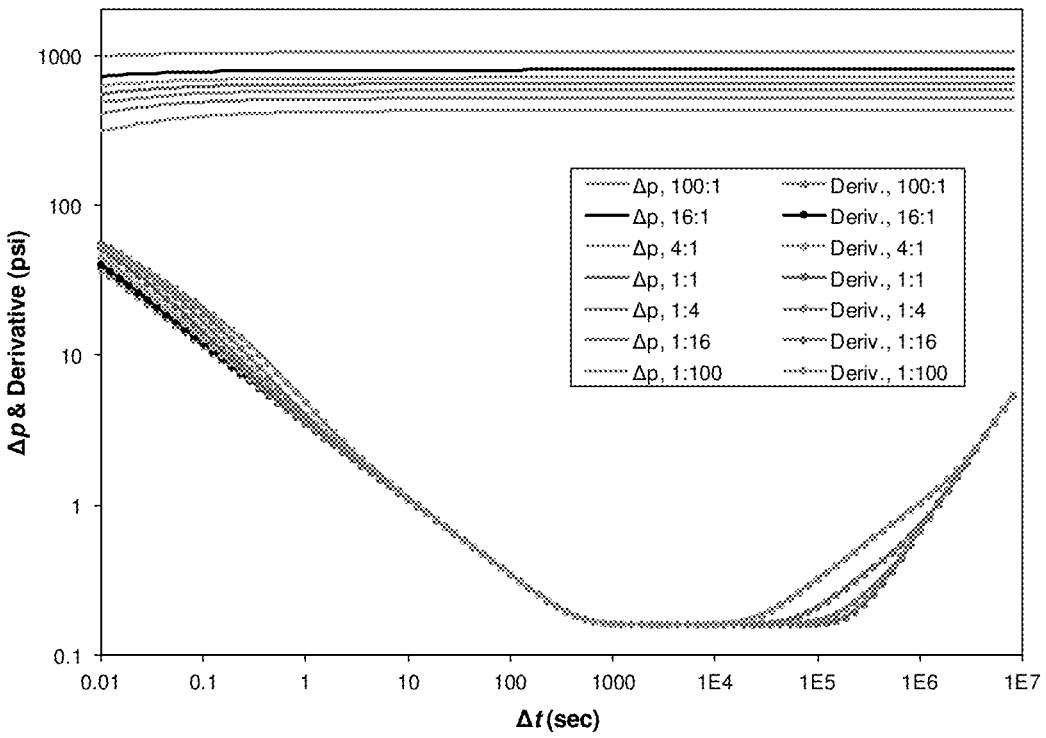
FIG. 16 is a plot of pressure change and derivative at the flowing probe, sensitivity to 3D anisotropy.
Figure 17:
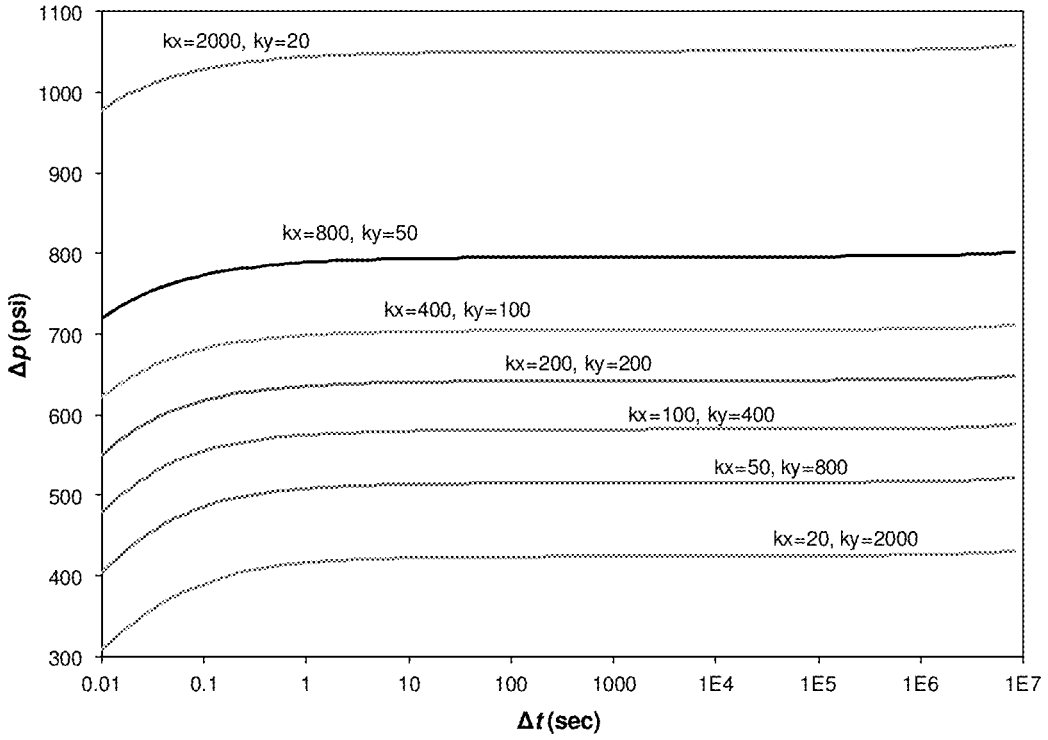
FIG. 17 is a plot of pressure change at the flowing probe, sensitivity to 3D anisotropy.
Figure 18:
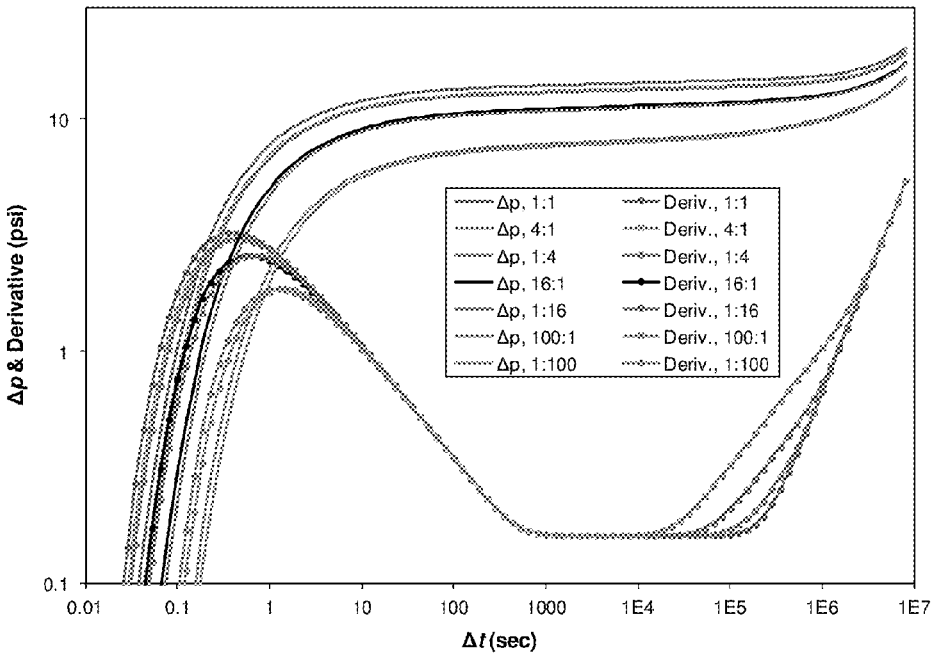
FIG. 18 is a plot of pressure change and derivative at the 180 deg horizontal probe, sensitivity to 3D anisotropy.
Figure 19:
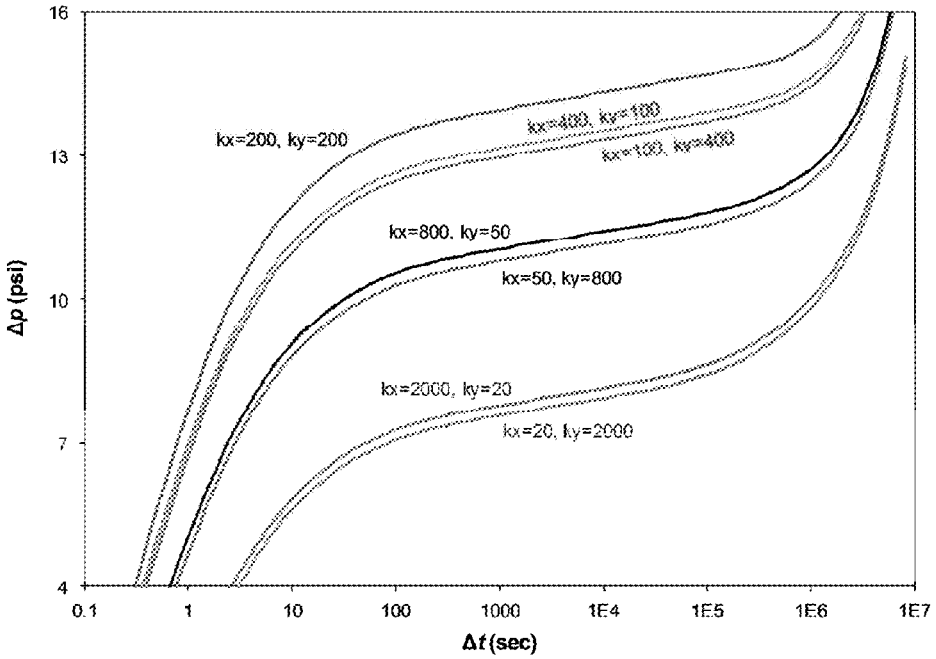
FIG. 19 is a plot of pressure change at 180 deg horizontal probe sensitivity to 3D anisotropy.
Figure 20:
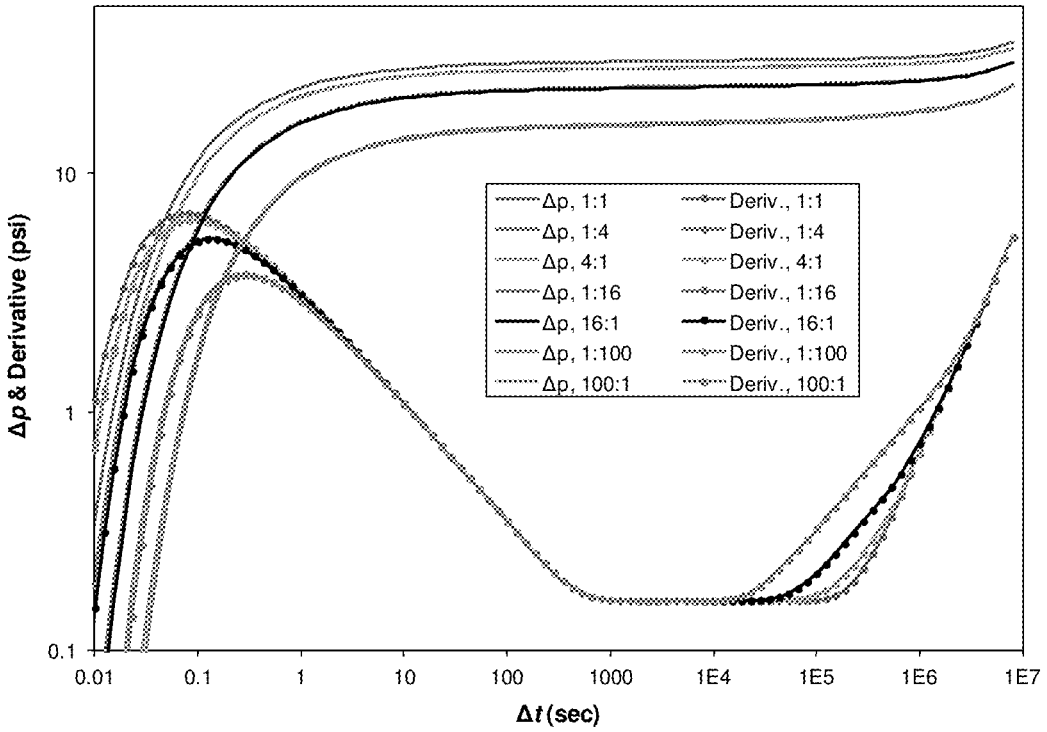
FIG. 20 is a plot of pressure change and derivative at the 90 deg horizontal probe, sensitivity to 3D anisotropy.
Figure 21:
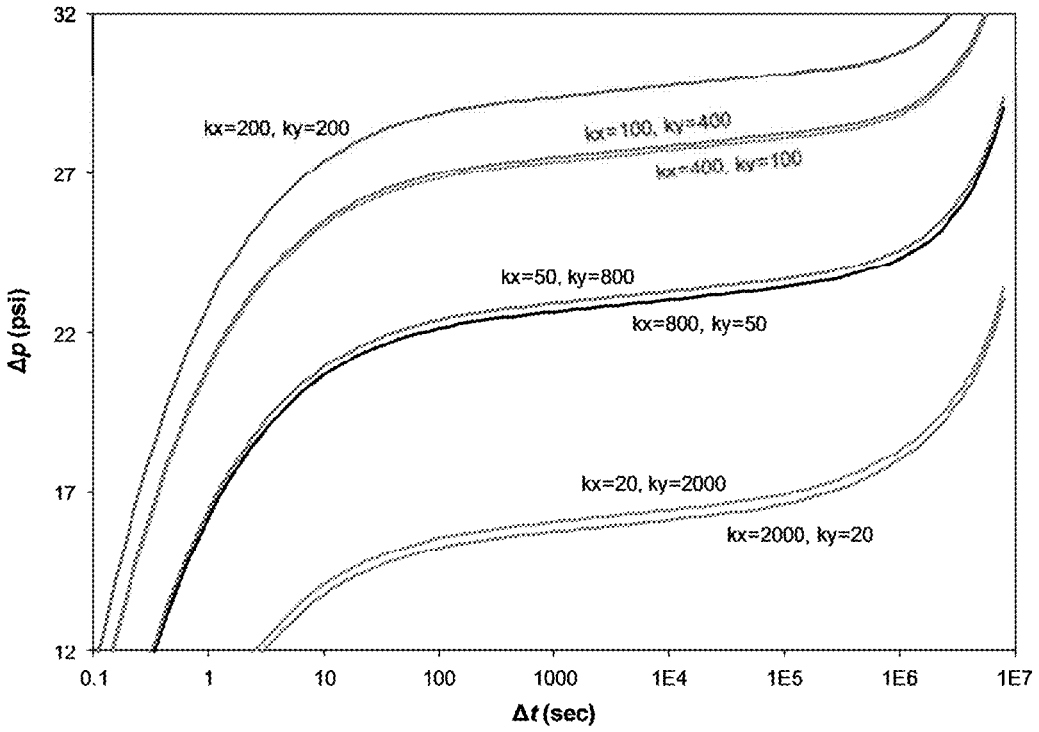
FIG. 21 is plot of pressure change at the 90 deg horizontal probe, sensitivity to 3D anisotropy.
Figure 22:
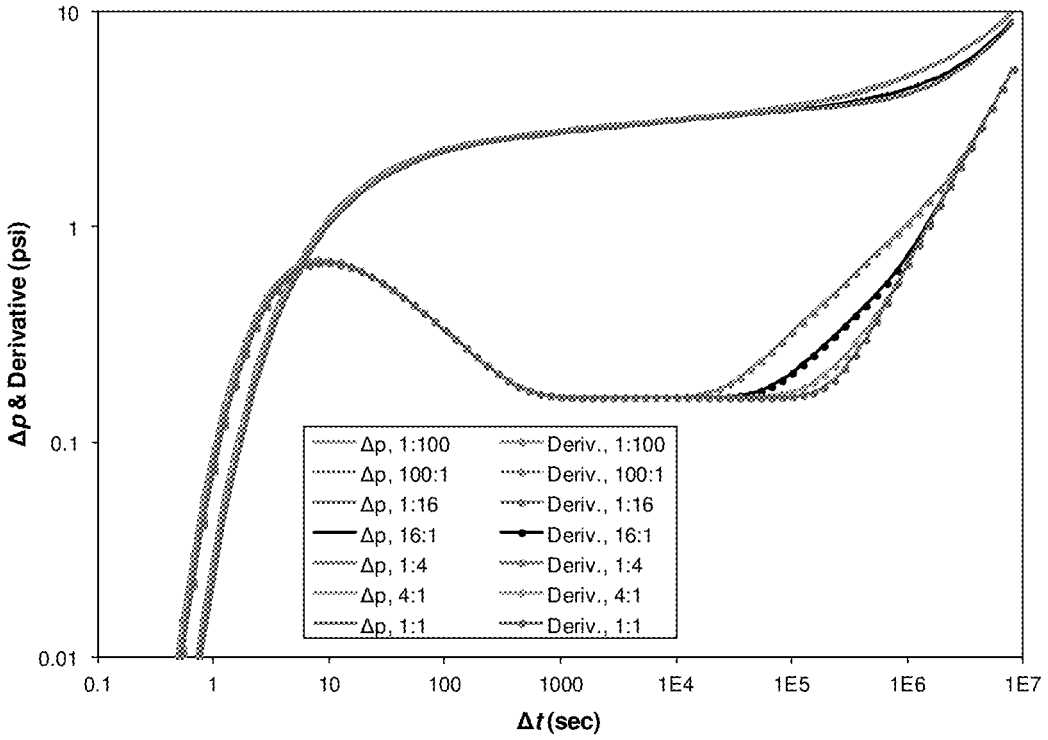
FIG. 22 is a plot of pressure change and derivative at vertical probe, sensitivity to 3D anisotropy.
Figure 23:
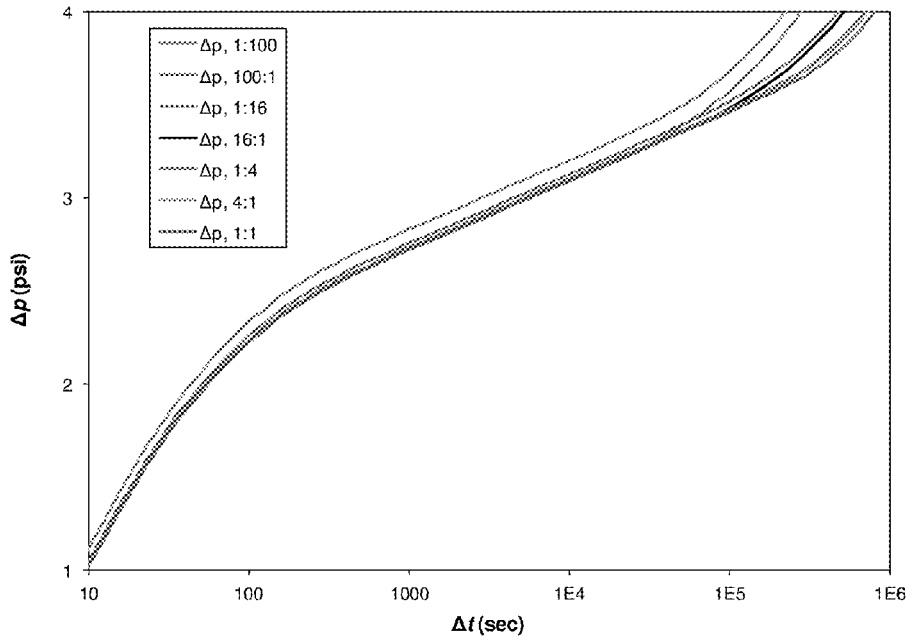
FIG. 23 is a plot of pressure change at the vertical probe, sensitivity to 3D anisotropy.

FIGS. 16 (log-log) and 17 (semilog) present the pressure responses at the flowing probe. All derivative curves overlay during spherical and radial flow, so the effect of horizontal anisotropy is the appearance of a skin effect. The results for the 180 degree horizontal observation probe (FIGS. 18 and 19), and the 90 degree horizontal observation probe (FIGS. 20 and 21) show that the pressure response always decreases as anisotropy increases, but that the direction of anisotropy is not significant. That is, detection and quantification of horizontal anisotropy from a horizontal observation probe is possible, but it is not possible to determine which component value is $k_x$ and which is $k_y$. The results for the vertical observation probe (FIGS. 22 and 23) show that this location is practically insensitive to horizontal anisotropy.

The previous examples all assumed that the flowing and observation probes were aligned with the principal directions of horizontal permeability. In the set of examples that follow, the effect of alignment is investigated. As provided, the flowing probe was oriented at an angle of 45 degrees with respect to the horizontal permeability directions. Observation probes are still referenced with respect to the flowing probe.

Figure 24:
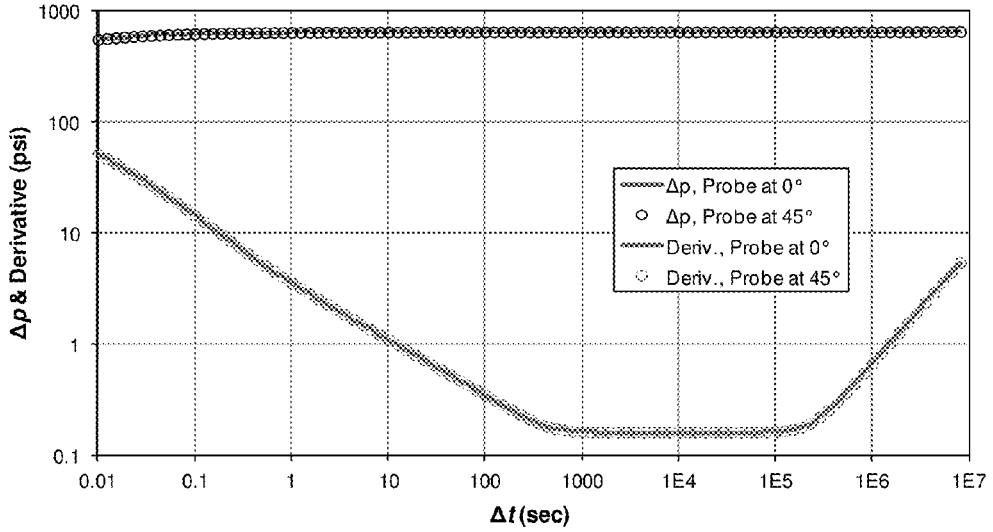
FIG. 24 is a plot of pressure change and derivative at the flowing probe—effect of flowing probe alignment, isotropic horizontal permeability.
Figure 25:
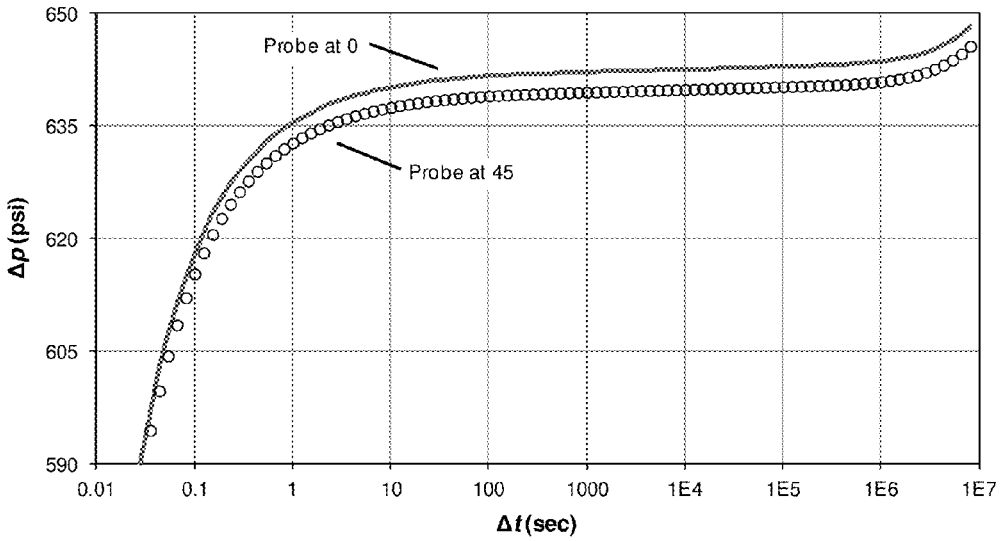
FIG. 25 is a plot of pressure change at the flowing probe—effect of flowing probe alignment, isotropic horizontal permeability ($k_x$=$k_y$=200 md).

The validation test case used earlier is isotropic in the horizontal plane ($k_x$=$k_y$=200 md), so the results should be independent of probe alignment. FIG. 24 illustrates the numerical model results (pressure change and derivative) for the flowing probe aligned at 0 degrees and 45 degrees, the curves overlay well. FIG. 25 presents the Δp values on a semilog scale and a slight shift of 3 psi. is apparent. The shift represents a relative difference of less than 0.5% and is caused by grid orientation effects. Thus, even using small grid blocks to represent the probe, it is impossible to exactly model a 45 degree rectangular source (probe) with an x-y grid. In summary, FIGS. 24 and 25 show that the numerical model produces accurate results when the flowing probe is not aligned with the principal directions of permeability. Although not shown, the results for the three observation locations also show virtually no change depending on flowing-probe alignment for the $k_x$=$k_y$ case.

To examine sensitivity to flowing probe alignment, the same three cases as displayed earlier in FIGS. 8 to 15 were run—the validation test case ($k_x$ and $k_y$=200 md), $k_x$=800 and $k_y$=50 md, and $k_x$=50 with $k_y$=800 md. All three cases again had vertical permeability $k_z$=20 md.

Figure 26:
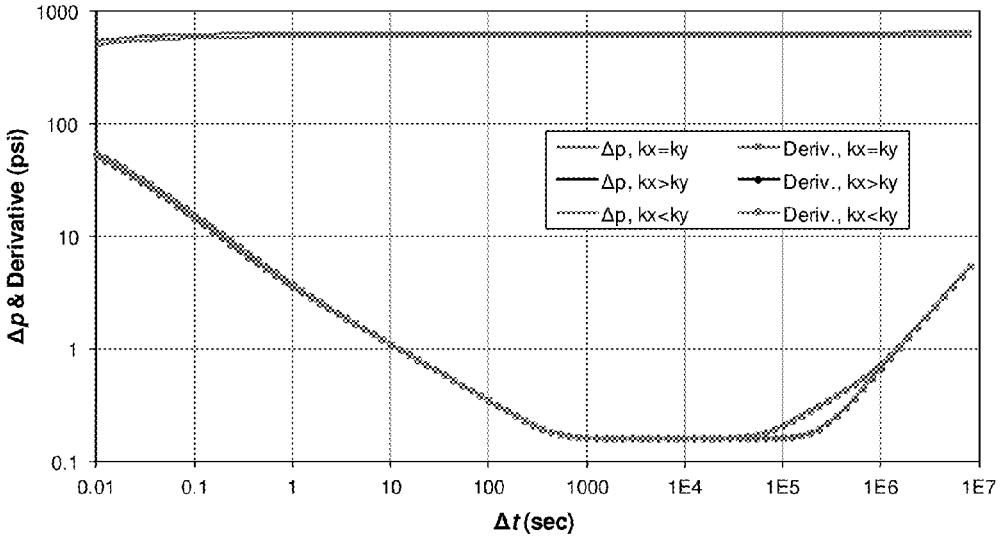
FIG. 26 is a plot of pressure change and derivative at the flowing probe, effect of flowing probe aligned at 45 degrees.
Figure 27:
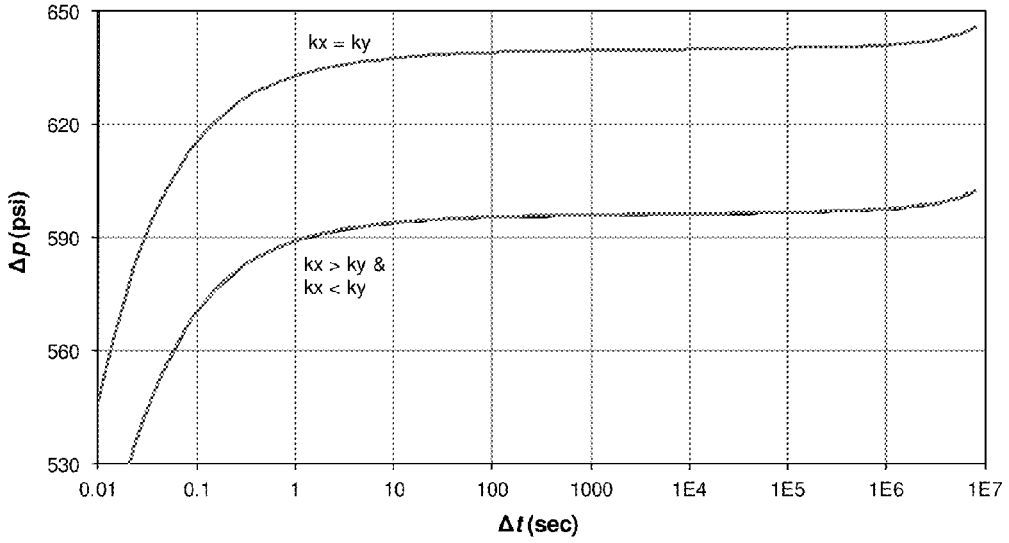
FIG. 27 is a plot of pressure change at the flowing probe, effect of flowing probe aligned at 45 degrees.

FIGS. 26 (log-log) and 27 (semilog) show the results for the flowing probe. There is an offset in Δp values between the isotropic case and the anisotropic cases. However, the results from the two anisotropic cases are identical. That is, with the flowing probe oriented at 45 degrees, the pressure change at the flowing probe is dependent on the magnitude of horizontal anisotropy but independent of the direction of anisotropy. This behavior is in sharp contrast to that of FIGS. 8 and 9 with the probe oriented at 0 degrees, which show a strong dependence on the direction of anisotropy.

Figure 28:
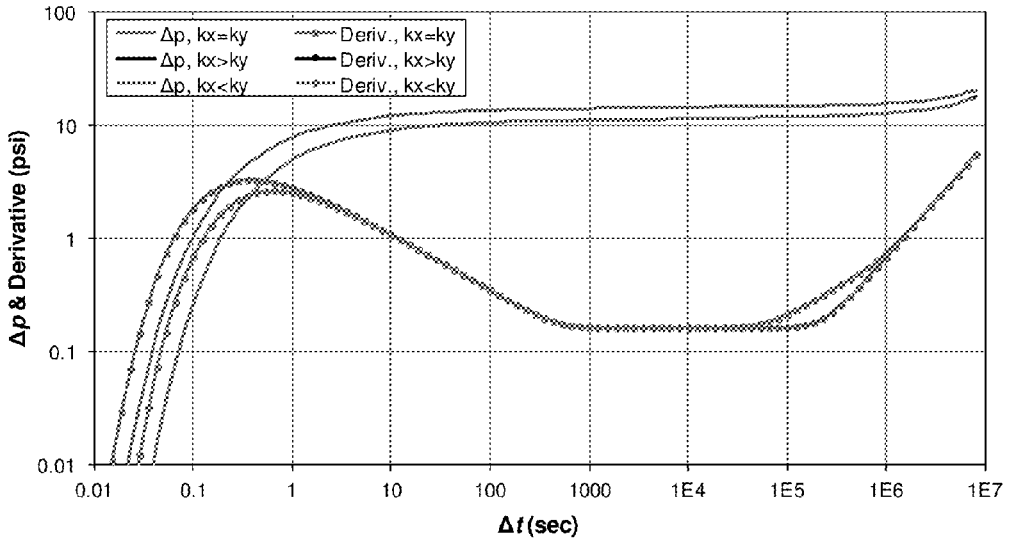
FIG. 28 is a plot of pressure change and derivative at the 180 deg horizontal probe (; effective of flowing probe aligned at 45 degrees.
Figure 29:
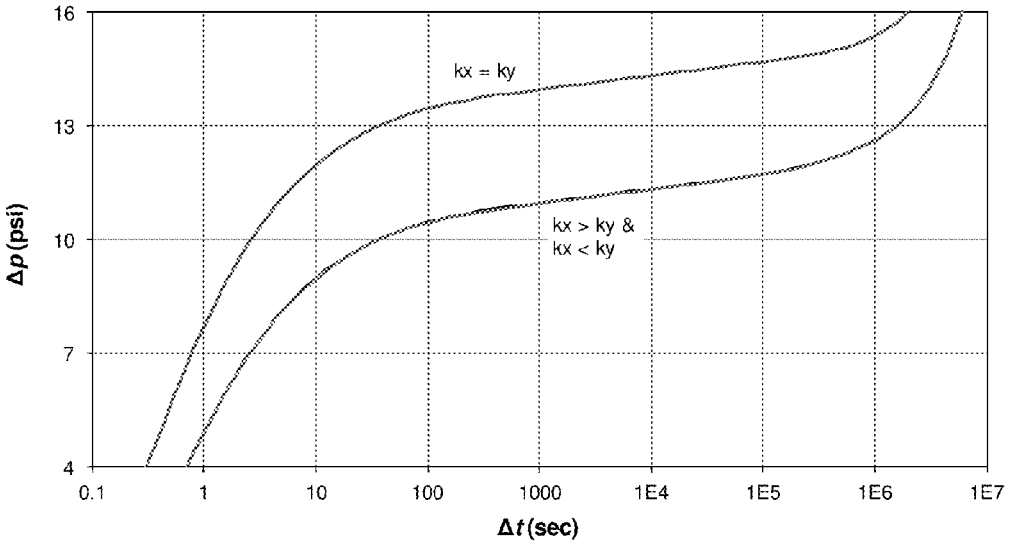
FIG. 29 is a plot of pressure change at the 180 deg horizontal probe; effect of flowing probe aligned at 45 degrees.

FIGS. 28 (log-log) and 29 (semilog) display the pressure responses at the 180 degree horizontal observation probe. In all respects, these results mimic those of the flowing probe—the pressure change is dependent on the magnitude of horizontal anisotropy but independent of the direction of anisotropy. As noted earlier, the observation probe is largely unaffected by skin effect. Therefore, from an interpretation perspective, FIGS. 28 and 29 indicate that data from the 180 degree horizontal observation probe could be used to determine $k_h$ as well as unique values for the two components, $k_x$ and $k_y$, regardless of the orientation of the flowing probe. However, it would not be possible to determine which value is in the x-direction and which value is in the y-direction.

Figure 30:
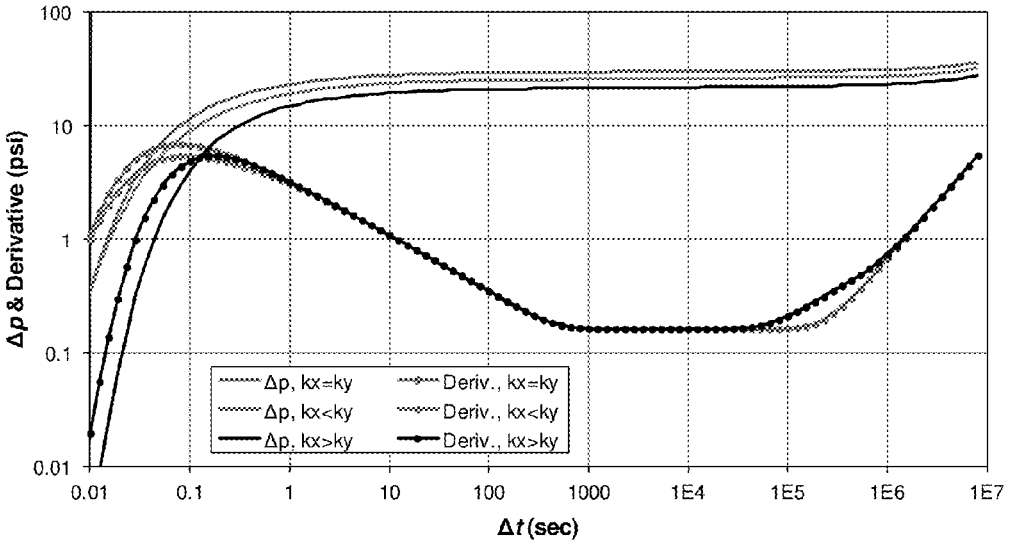
FIG. 30 is a plot of pressure change and derivative at the 90 deg horizontal probe; effect of flowing probe aligned at 45 degrees.
Figure 31:
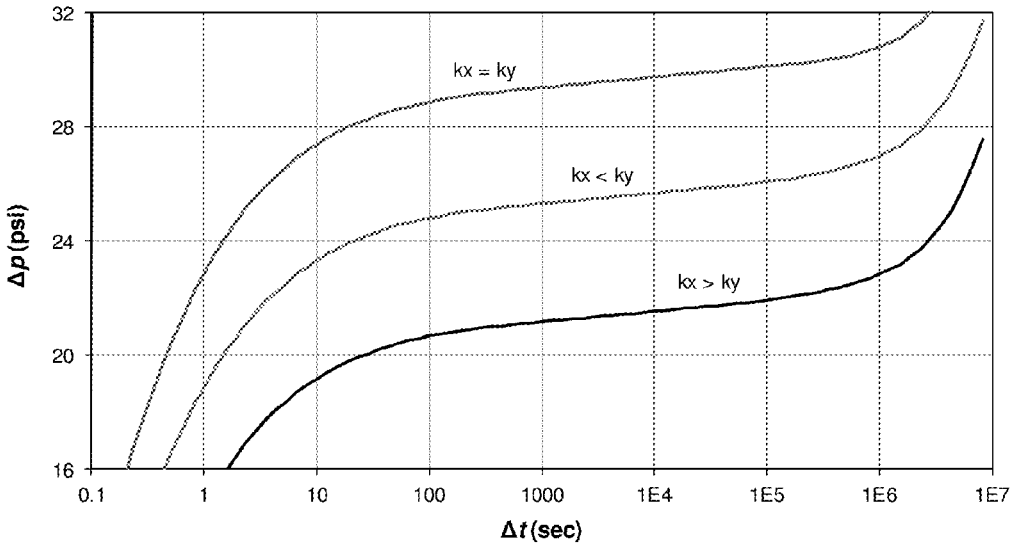
FIG. 31 is a plot of pressure change at the 90 deg horizontal probe; effect of flowing probe aligned at 45 degrees.

FIGS. 30 (log-log) and 31 (semilog) show the pressure responses at the observation location in the horizontal plane at 90 degrees. These figures show that the flowing probe orientation now has a strong influence on the results. The pressure change is sensitive to both the magnitude and direction of anisotropy; it would be possible to determine component values, $k_x$ and $k_y$, and it would be possible to determine which value is in the x-direction and which value is in the y-direction. This behavior is again in sharp contrast to that of the 0 degree oriented flowing probe of FIGS. 12 and 13.

Figure 32:
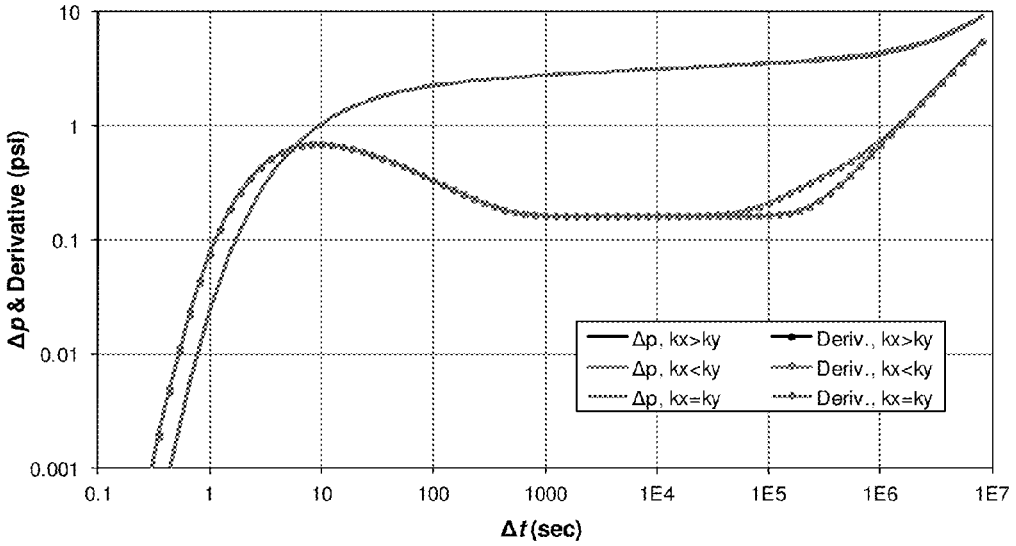
FIG. 32 is a plot of pressure change and derivative at the vertical probe; effect of flowing probe aligned at 45 degrees.
Figure 33:
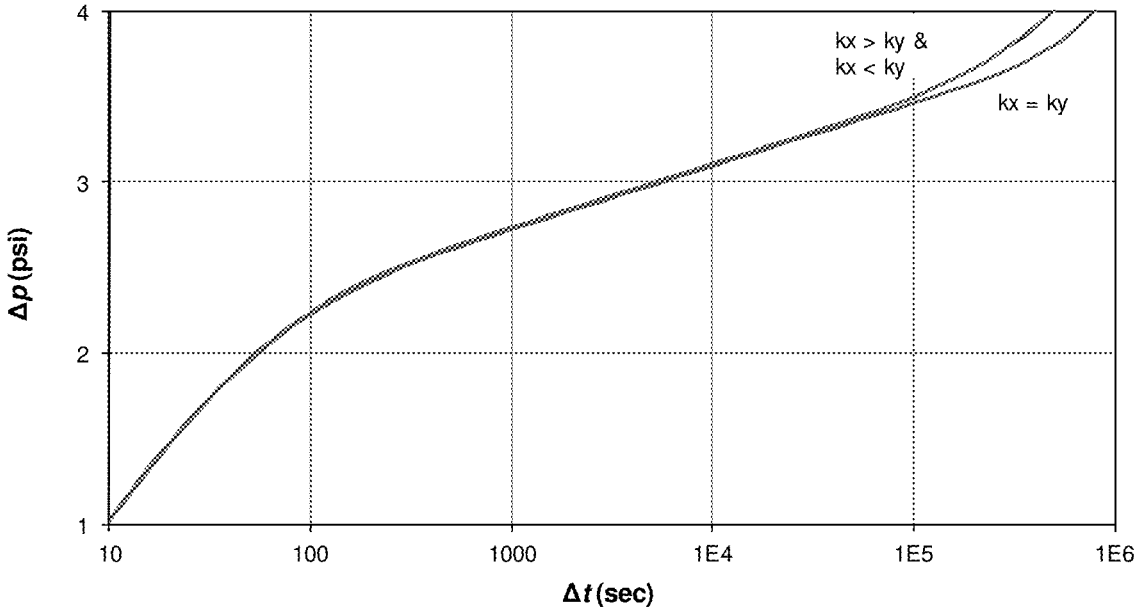
FIG. 33 is a plot of pressure change at the vertical probe; effect of flowing probe aligned at 45 degrees.

FIGS. 32 (log-log) and 33 (semilog) display the pressure responses at the vertical observation probe. Comparing these results with those of FIGS. 14 and 15 for the 0 degree oriented flowing probe shows that a vertically displaced observation probe is unaffected by the flowing probe orientation.

A numerical simulation model has been developed to study the formation pressure response for flow from a discrete opening (probe) source in a reservoir with 3D permeability anisotropy. The model was validated by comparing its results with those from an analytical model for 2D anisotropy. Results of the 3D numerical cases show that:

- The alignment of the flowing probe with respect to the principal directions of horizontal permeability has a strong influence on the responses of the flowing probe and 90 degree horizontal observation probe. Conversely, a 180 degree horizontal observation probe is not sensitive to the flowing probe alignment.
- The response at the flowing probe may contain information about the direction of anisotropy; however the anisotropy-influenced response at the flowing location mimics a skin effect, so in practice, it would not be possible to estimate unique values for skin and horizontal anisotropy from the location.
- A 90 degree horizontal observation probe is sensitive to both the magnitude and direction of anisotropy. This probe location is largely unaffected by skin effect; therefore it could be possible to determine component values $k_x$ and $k_y$ as well to determine which value is in the x-direction and which value is in the y direction.
- A 180 degree horizontal observation probe is sensitive to the magnitude of horizontal anisotropy, but not the direction. This is true regardless of the orientation of the flowing probe.

A vertical probe is not sensitive to anisotropy in the horizontal plane.

A method for determining permeability anisotropy in a horizontal plane of a subsurface reservoir is described, comprising: positioning a formation testing tool within a wellbore formed within the subsurface reservoir, wherein the tool has an opening to enable fluid communication with the reservoir, and the tool has a horizontally displaced observation probe configured to obtain data; measuring a flow response of the subsurface reservoir; determining at least one of horizontal permeability and horizontal mobility of the reservoir based on the measuring of the flow response of the subsurface reservoir; and determining orthogonal components of at least one of the horizontal permeability and horizontal mobility based on the measured flow response.

In another embodiment, the method may be accomplished wherein the opening is a focused opening.

In another embodiment, the method may be accomplished wherein the observation probe is configured as a horizontally displaced observation probe.

In another embodiment, the method may be accomplished wherein the observation probe is configured to obtain pressure data.

In another embodiment, the method may be accomplished wherein the determining the one of horizontal permeability and horizontal mobility of the reservoir based on the measuring of the flow response of the subsurface reservoir is at the observation probe.

In another embodiment, the method may be accomplished wherein the determining the one of horizontal permeability and horizontal mobility of the reservoir based on the measuring of the flow response of the subsurface reservoir is adjacent to the observation probe.

In another embodiment, the method may further comprise comparing the determined orthogonal components of the at least one of the horizontal permeability and horizontal mobility.

In another embodiment, the method may be accomplished wherein the measuring the flow response of the subsurface reservoir is performed by the probe.

In another embodiment, an article of manufacture is provided having a processor readable code embodied on the processor, said processor readable code for programming at least one processor to perform a method for determining permeability anisotropy in a horizontal plane of a subsurface reservoir, comprising: positioning a formation testing tool within a wellbore formed within the subsurface reservoir, wherein the tool has an opening to enable fluid communication with the reservoir, and the tool has an observation probe configured to obtain data; measuring a flow response of the subsurface reservoir; determining at least one of horizontal permeability and horizontal mobility of the reservoir based on the measuring of the flow response of the subsurface reservoir; and determining orthogonal components of at least one of the horizontal permeability and horizontal mobility based on the measured flow response.

While the aspects have been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method, comprising:

positioning a formation testing tool within a wellbore formed within a subsurface reservoir, wherein the tool has an opening to enable fluid communication with the reservoir, the tool has a horizontal observation probe configured to obtain data, and the horizontal observation probe is disposed 90 degrees away from the opening;

measuring a flow response of the subsurface reservoir using the horizontal observation probe disposed 90 degrees away from the opening;

determining via a processor of the formation testing tool at least one of horizontal permeability and horizontal mobility of the reservoir based on the measuring of the flow response of the subsurface reservoir;

determining via the processor of the formation testing tool orthogonal components of at least one of the horizontal permeability and horizontal mobility based on the measured flow response;

determining via the processor of the formation testing tool a permeability anisotropy in a horizontal plane of the subsurface reservoir based on the determined at least one of horizontal permeability and horizontal mobility of the reservoir and orthogonal components of at least one of the horizontal permeability and horizontal mobility; and conducting an operation to the subsurface reservoir based on the determined permeability anisotropy in the horizontal plane of the subsurface reservoir.

2. The method according to claim 1, wherein the opening is a focused opening.

3. The method according to claim 1, wherein the horizontal observation probe is configured as a horizontally displaced observation probe.

4. The method according to claim 1, wherein the horizontal observation probe is configured to obtain pressure data.

5. The method according to claim 1, wherein the determining the one of horizontal permeability and horizontal mobility of the reservoir based on the measuring of the flow response of the subsurface reservoir is at the observation probe.

6. The method according to claim 1, wherein the determining the one of horizontal permeability and horizontal mobility of the reservoir based on the measuring of the flow response of the subsurface reservoir is adjacent to the observation probe.

7. The method according to claim 1, further comprising:

comparing the determined orthogonal components of the at least one of the horizontal permeability and horizontal mobility.

8. The method according to claim 1, wherein the measuring the flow response of the subsurface reservoir is performed by the probe.

9. An article of manufacture having a processor readable code embodied on the processor, said processor readable code for programming at least one processor to perform a method comprising:

positioning a formation testing tool within a wellbore formed within the subsurface reservoir, wherein the tool has an opening to enable fluid communication with the reservoir, the tool has a horizontal observation probe configured to obtain data, and the horizontal observation probe is disposed 90 degrees away from the opening;

measuring a flow response of the subsurface reservoir using the horizontal observation probe disposed 90 degrees away from the opening;

determining via the processor of the formation testing tool at least one of horizontal permeability and horizontal mobility of the reservoir based on the measuring of the flow response of the subsurface reservoir;

determining via the processor of the formation testing tool orthogonal components of at least one of the horizontal permeability and horizontal mobility based on the measured flow response;

determining via the processor of the formation testing tool the permeability anisotropy in the horizontal plane of the subsurface reservoir based on the determined at least one of horizontal permeability and horizontal mobility of the reservoir and orthogonal components of at least one of the horizontal permeability and horizontal mobility; and conducting an operation to the subsurface reservoir based on the determined permeability anisotropy in the horizontal plane of the subsurface reservoir.

10. The article of manufacture according to claim 9, wherein the opening is a focused opening.

11. The article of manufacture according to claim 9, wherein the observation probe is configured as a horizontally displaced observation probe.

* * * * *